US012465966B2

(12) United States Patent
Hamide

(10) Patent No.: US 12,465,966 B2
(45) Date of Patent: Nov. 11, 2025

(54) DEVICE FOR COOLING A STEEL STRIP

(71) Applicant: ArcelorMittal, Luxembourg (LU)

(72) Inventor: Makhlouf Hamide, Thionville (FR)

(73) Assignee: ArcelorMittal, Luxembourg (LU)

( * ) Notice: Subject to any disclaimer, the term of this patent is extended or adjusted under 35 U.S.C. 154(b) by 787 days.

(21) Appl. No.: 17/632,180

(22) PCT Filed: Jul. 29, 2020

(86) PCT No.: PCT/IB2020/057132
§ 371 (c)(1),
(2) Date: Feb. 1, 2022

(87) PCT Pub. No.: WO2021/024096
PCT Pub. Date: Feb. 11, 2021

(65) Prior Publication Data

US 2022/0226872 A1 Jul. 21, 2022

(30) Foreign Application Priority Data

Aug. 6, 2019 (WO) ..... PCT/IB2019/056684

(51) Int. Cl.
*B21B 45/02* (2006.01)

(52) U.S. Cl.
CPC ..... *B21B 45/023* (2013.01)

(58) Field of Classification Search
CPC ..... B21B 45/023; C21D 1/667; C21D 1/60; C21D 1/63; C21D 9/46; C21D 1/64; C21D 9/573; C21D 1/26; C21D 9/52
(Continued)

(56) References Cited

U.S. PATENT DOCUMENTS 4,046,604 A * 9/1977 Yamagishi ..... C25D 5/505 148/522
4,838,526 A * 6/1989 Iida ..... C21D 9/573 266/112

(Continued)

FOREIGN PATENT DOCUMENTS

CN 202081147 U 12/2011
DE 699 17553 T2 6/2005

(Continued)

OTHER PUBLICATIONS

Search Report of PCT/IB2020/057132 dated Oct. 1, 2020.

*Primary Examiner* — Jessee R Roe
*Assistant Examiner* — Michael Aboagye
(74) *Attorney, Agent, or Firm* — Davidson Kappel LLC

(57) ABSTRACT

A cooling device for a cooling operation of a flat metallic product is provided, the cooling device being located in an essentially vertical path including: a tank filled with a coolant bath defining a coolant surface, the tank including at least two openings, one on the upper surface and one on the bottom surface wherein the flat metallic product can pass through, the opening on the bottom surface being equipped with a sealing mean, two series of projecting devices, oriented essentially horizontally, on two opposite tank sides, the projecting devices being immersed in the coolant bath, each series of projecting devices having an uppermost projecting device being defined as the closest projecting device to the coolant surface, at least the uppermost projecting device on both sides being downwardly inclined of an angle of 20° to 40° compared to the horizontal.

13 Claims, 6 Drawing Sheets

(58) Field of Classification Search
USPC ..... 266/46, 112, 113
See application file for complete search history.

(56) References Cited

U.S. PATENT DOCUMENTS

| | | | | |
|---|---|---|---|---|
| 7,645,417 | B2 * | 1/2010 | Lecomte | C21D 9/573 266/131 |
| 10,501,838 | B2 * | 12/2019 | Oohashi | C23C 2/20 |
| 10,844,449 | B2 * | 11/2020 | Yoshimoto | C21D 9/5737 |

FOREIGN PATENT DOCUMENTS

| | | | |
|---|---|---|---|
| EP | 1 300478 | B1 | 6/2006 |
| EP | 3399056 | A1 | 11/2018 |
| JP | S57147261 | U | 9/1982 |
| JP | S59153843 | A | 9/1984 |
| JP | S609834 | A | 1/1985 |
| JP | 10 2008 028592 | B3 | 12/2009 |

* cited by examiner

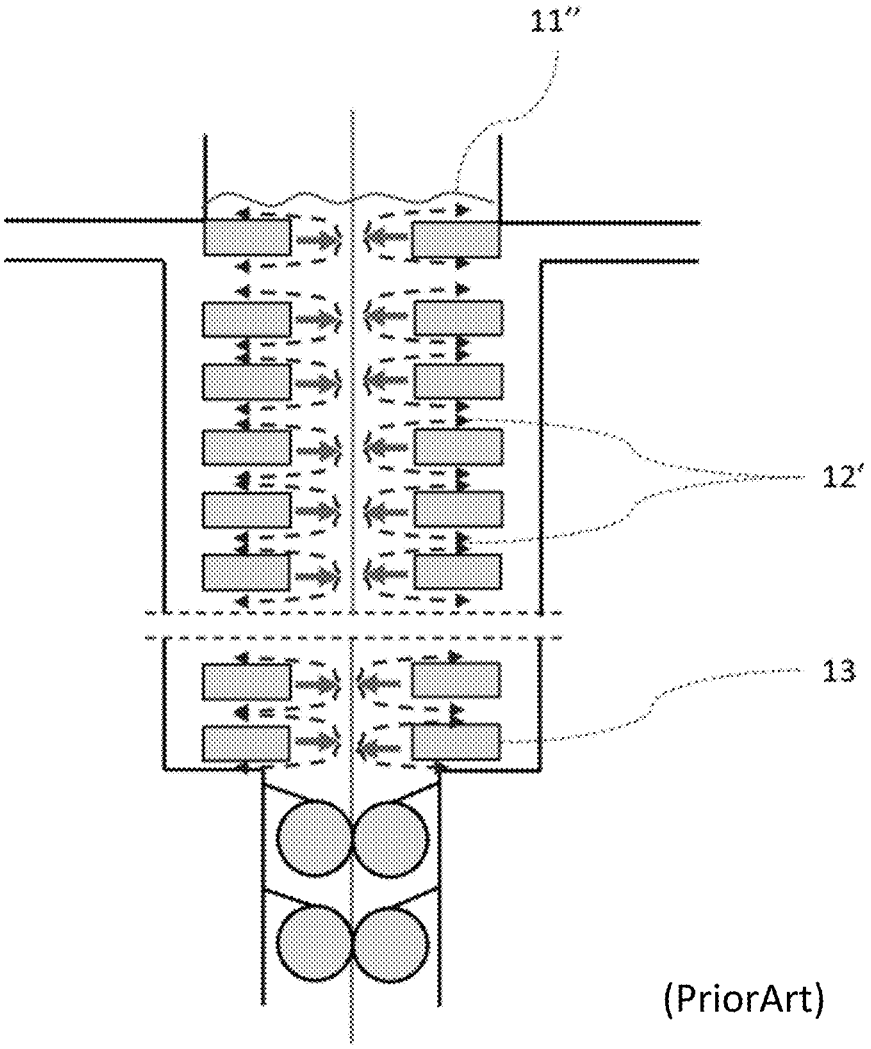
(PriorArt)
Figure 7

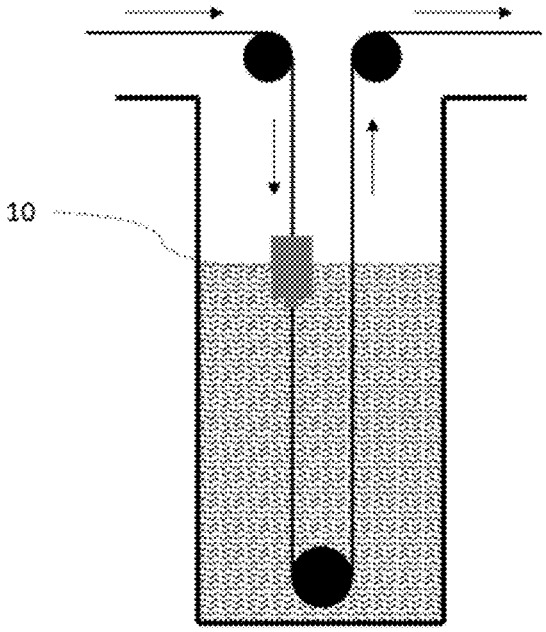
Figure 9A
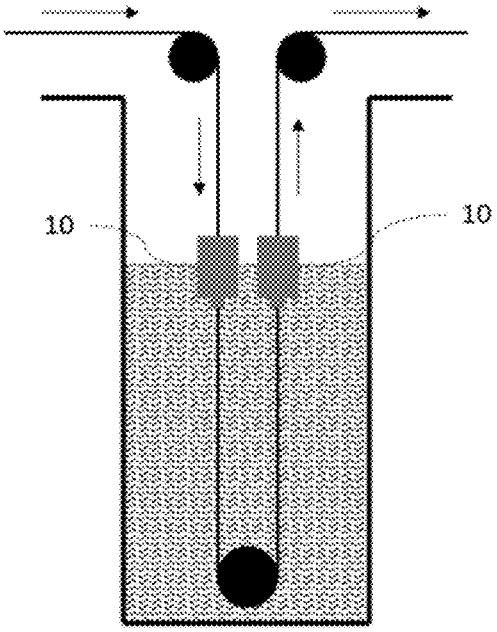
Figure 9B
Figure 10A
Figure 10B
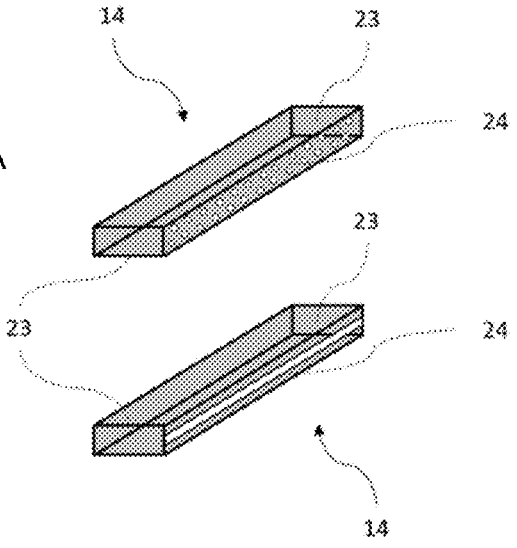

DEVICE FOR COOLING A STEEL STRIP

BACKGROUND

The present invention relates to a device for cooling a metallic strip. Particularly, this invention is aimed at improving the rapid cooling of an annealing process.

During its manufacture, a metallic strip undergoes several thermal treatments, notably after its cold rolling where it is annealed. Through the annealing process, the metallic product is rapidly heated at a temperature generally comprised between 700 and 850° C. and maintained at the maximal temperature for about one minute. Then the metallic product undergoes a cooling treatment where it is cooled at a controlled cooling rate. Ultimately, the overaging and the final cooling take place.

In the case of a steel strip, thanks to the thermal treatments, several phenomena occur such as the recrystallisation and the carbides precipitation. All those treatments allow a desired structure improving the resistance and the formability of the strip to be obtained.

For particular steels such as: the (TRIP) TRansformation Induced Plasticity, the multiphase steels, the high-specific strength steel; the annealing generally comprises two coolings, a first slow one and then a second rapid one.

As illustrated in FIG. 1, the two coolings can be done in a device 1 combining a cooling in a tank 2 containing a coolant 3 and a faster cooling in a consecutive cooling device 4 containing a coolant. The arrows represent the flat metallic product moving direction. As illustrated in FIG. 2, U.S. Pat. No. 7,645,417 B2 discloses a cooling device, comprising a tank 5 in which two series (6 and 6') of immersed tubes 7 are vertically stacked on both sides of a strip 8. Said tubes projects onto the strip a coolant in the form of essentially horizontal turbulent jets.

SUMMARY OF THE INVENTION

Even though a high cooling rate is achieved, greater than 1000° C., this device is not satisfactory because the cooling is not homogeneous in the strip width direction leading to flatness defects. Consequently, there is a need to improve the product flatness of the exiting metallic flat product. Thus, the cooling device 4 needs to be improved.

Moreover, sealing means 9 usually isolates the tank 2 and the cooling device 4 to limit the influence of the coolant 3 onto the cooling device 4. Furthermore, the coolant temperature in the cooling device 4 is generally inferior to the one of the tank 2 coolant. Any leakage from one space to another would create temperature gradient negatively impacting the cooling homogeneity. EP 1 300 478 B1 extensively describes a sealing means 9 and its advantages.

One purpose of this invention is to solve the aforementioned problem.

The present invention provides a cooling device (10) for a cooling operation of a flat metallic product (S), said cooling device being located in an essentially vertical, ascending or descending, path comprising:

- a tank (15) filled with a coolant bath (17) defining a coolant surface (11),
- said tank comprising at least two openings, one on the upper surface (16) and one on the bottom surface (16'), through which said flat metallic product (S) can go, describing a path,
- said opening on the bottom surface (16') being equipped with a sealing means (9),

- two series (18 and 18'), of projecting devices (13) comprising at least an aperture (13E) being immersed in said coolant bath, facing each other on each side of said path
- said projecting devices (13) being at least partly immersed in said coolant bath (17),
- any two vertically successive projecting devices of a series being separated by a gap (19),
- each series (18 and 18') of projecting devices (13) having an uppermost projecting device (20 and 20') being defined as the closest projecting device to the coolant surface (11),
- at least the uppermost projecting device (20 and 20') on both sides being downwardly inclined of an angle of 20° to 40° compared to the horizontal.

The present invention also provides a cooling method wherein a flat metallic product moving essentially vertically, ascendingly or descendingly, is cooled in a device as described above, wherein said series of projecting devices eject a coolant flux between 250 $m^3$ and 2,500 $m^3$ per hour per surface of flat product.

BRIEF DESCRIPTION OF THE DRAWINGS

Other characteristics and advantages of the invention will become apparent from the following detailed description of the invention.

To illustrate the invention, various embodiment of non-limiting example will be described, particularly with reference to the following figures:

FIG. 7 exhibits a coolant bath surface 11" and coolant streams 12' of an embodiment as disclosed in the state of the art.

FIGS. 9A and 9B exhibit two other possible uses of the claimed device.

FIGS. 10A and 9B exhibit two embodiments of tubes 14 of the present invention.

DETAILED DESCRIPTION

FIGS. 2 to 7 do not exhibit all the elements of the cooling device but the main elements permitting to understand the invention and its difference with the known state of the art. For example, the system permitting to flow the coolant into the projecting devices are not represented.

Figure 3:
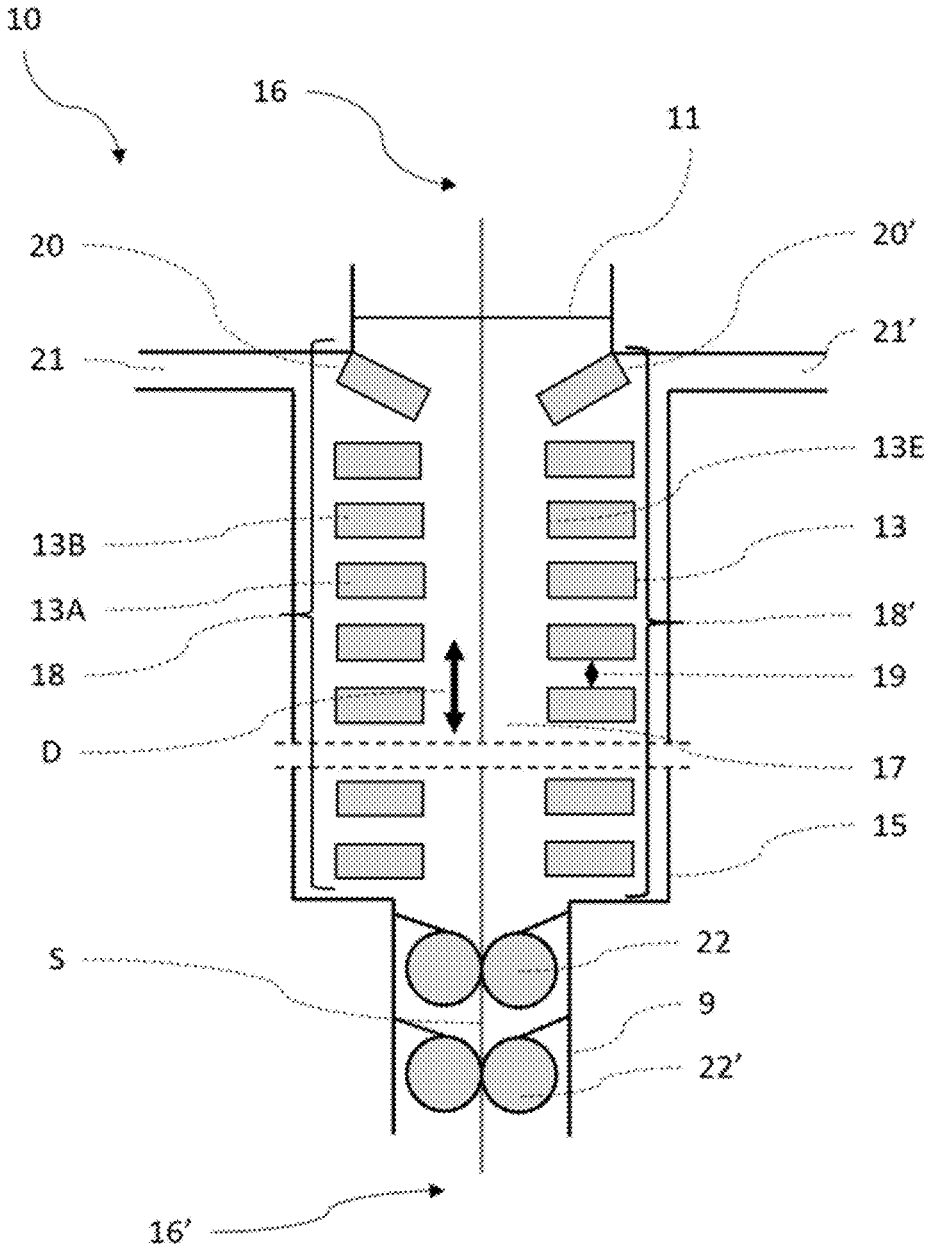
FIG. 3 exhibits an embodiment of the present invention, a cooling device 10.

As illustrated in FIG. 3, the invention relates to a cooling device 10 for a cooling operation of a flat metallic product S, said cooling device being located in an essentially vertical, ascending or descending, path comprising:

- a tank 15 filled with a coolant bath 17 defining a coolant surface 11, said tank comprising at least two openings, one on the upper surface 16 and one on the bottom surface 16', through which said flat metallic product S can go, describing a path, said opening on the bottom surface 16' being equipped with a sealing means 9, two series (18 and 18'), of projecting devices 13 comprising at least an aperture 13E being immersed in said coolant bath, facing each other on each side of said path, said projecting devices 13 being immersed in said coolant bath 17, any two vertically successive projecting devices of a series being separated by a gap 19, each series (18 and 18') of projecting devices 13 having an uppermost projecting device (20 and 20') being defined as the closest projecting device to the coolant surface 11, at least the uppermost projecting device (20 and 20') on both sides being downwardly inclined of an angle of 20° to 40° compared to the horizontal.

In the following specification, the flat metallic product S will be referred as a strip. However, said flat metallic product is not limited to a strip.

Figure 4:
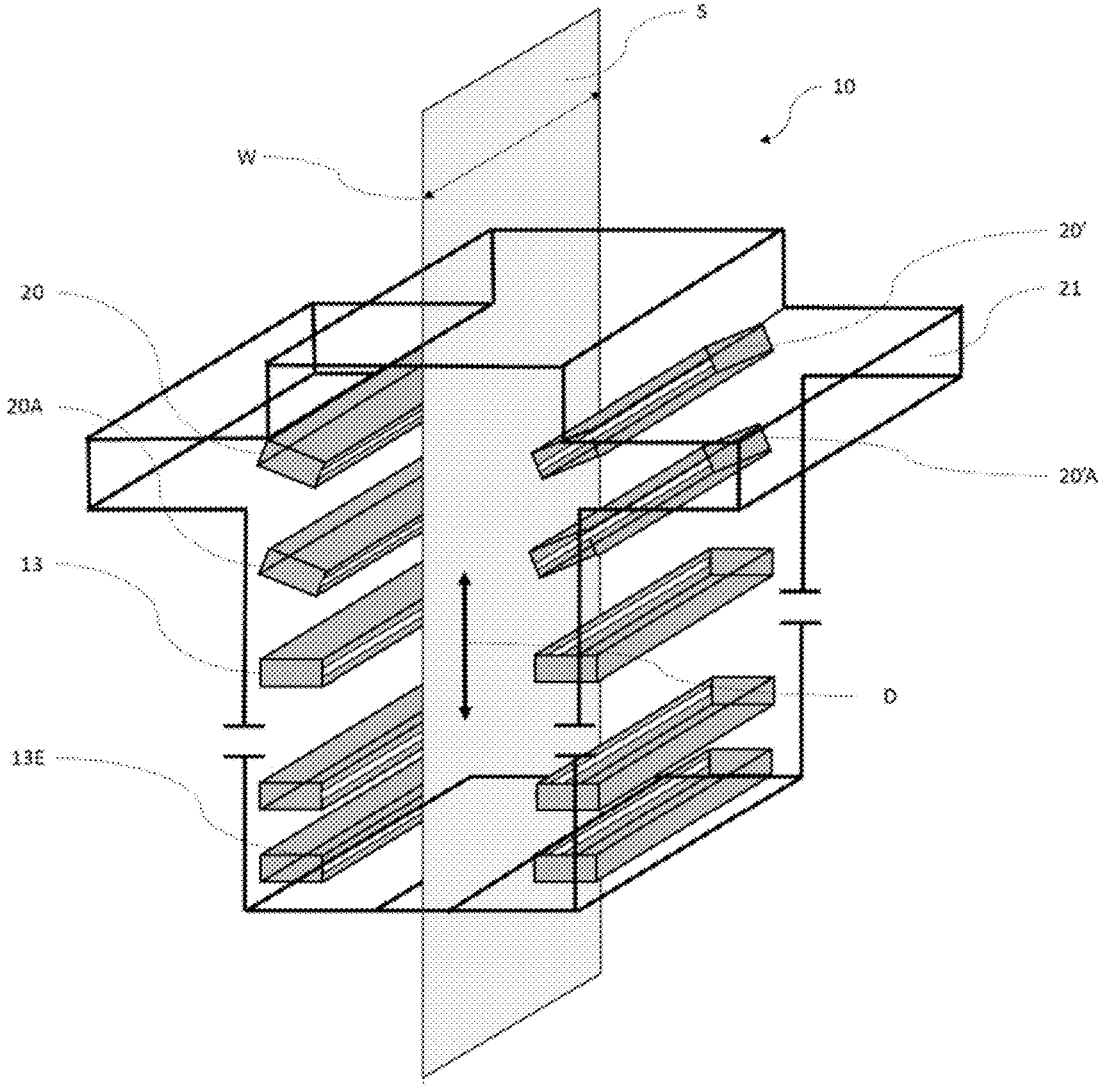
FIG. 4 exhibits a second embodiment of the present invention, a cooling device 10.

As illustrated in FIGS. 3 and 4, the fast cooling device 10 is used to cool and/or quench a flat metallic product, such as a steel strip. The sealing means are not represented in FIG. 4.

The cooling device is positioned in an essentially vertical, ascending or descending, path of the flat metallic product. It means that when the flat metallic product passes through the cooling device, its moving direction is essentially vertical as represented by the arrow D.

The cooling device comprises a tank 15 containing a coolant bath 17 which defines a coolant surface 11. The primary role of the tank is to contain a coolant creating a coolant bath. The coolant is preferably a liquid and can be water. Its secondary role is to isolate the coolant bath from the exterior which permits to control the coolant parameters, such as the temperature, and the projected coolant fluxed.

Moreover, said tank comprises at least two openings, one on its upper side 16 and one on its bottom side 16', through which said flat metallic product S can go, describing a path. The role of those openings is to let the flat metallic product pass through the cooling device 10. They should also prevent the entrance of any external liquid into the coolant bath 17. Said openings wherein the strip pass through should be essentially vertically aligned so the strip can have an essentially vertical path. The path described by said flat metallic product is essentially vertical.

Furthermore, the tank preferably comprises at least two lateral openings (21 and 21') allowing the coolant discharge.

The opening on the bottom side is equipped with a sealing means 9 to improve the coolant bath isolation from the exterior. As illustrated in FIG. 3, the sealing means can comprise a double pair of rollers (22 and 22') pressed against the strip S and positioned symmetrically relative to the latter. Moreover, a fluid can be injected with a controllable pressure and/or temperature between the rollers.

As illustrated in FIGS. 3 and 4, two series (18 and 18'), of projecting devices 13 comprising at least an aperture 13E, are facing each other. In other words, the two series (18 and 18') are on both sides of said flat metallic product vertical path. Preferably, said two series of projecting device are positioned on two opposite tank sides. Each series is made of several projecting devices 13 essentially vertically aligned and positioned to homogeneously cool the strip in its width direction W. The projected coolant should be distributed along the strip width to achieve a homogeneous cooling in the strip width direction.

The coolant is projected through apertures 13E in said projecting devices 13. Said apertures 13 are among other possibilities: a slit, a hole or a series of holes. Said projecting devices apertures 13E are completely immersed in the coolant bath. Such an immersion permits to suppress or at least lower the gas bubble or vapor formation (and presence) in the coolant bath close to the strip compared to non-immersed apertures. Preferentially said projecting devices are completely immersed in said coolant.

Figure 5:
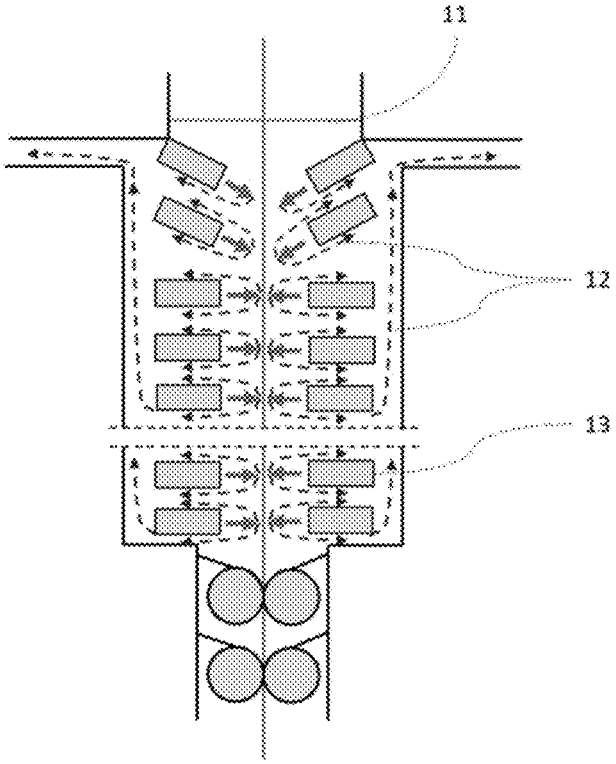
FIG. 5 exhibits a coolant bath surface 11 and coolant streams 12 of an embodiment of a cooling device of the present invention.
Figure 6:
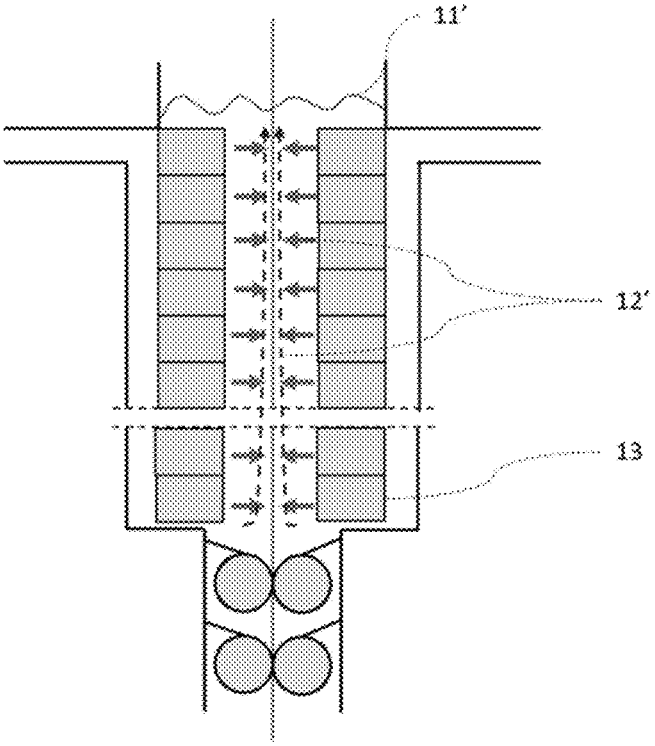
FIG. 6 exhibits the influence of a gap between the projecting devices 13 on a coolant bath surface 11' and coolant streams 12' of a cooling device.

A gap 19 separates two vertically successive projecting devices (e.g. 13A and 13B) of a series (18 and 18') of projecting devices. As illustrated in FIG. 5, such a gap permits to improve the cooling efficiency of the sprayed coolant by improving the renewal of the coolant in contact to the strip and heat exchange between the projected coolant and the strip. If there was no gap between the projecting devices, the coolant could only evacuate by flowing 12' vertically along the strip thus reducing the cooling efficiency, as illustrated in FIG. 6. On the contrary, such a gap permits the discharge of the coolant perpendicularly to the strip surface. Moreover, absence of gap would also promote the creation of turmoil at the bath surface 11'.

The closest projecting device, of each series, to the coolant bath surface 11 comprised in the tank 15 is referred as the uppermost projecting device (20 and 20'). As illustrated in FIGS. 3, 4 and 5, at least the uppermost projecting device of a series is downwardly inclined of an angle comprised between 20° and 40° to the horizontal. Such an inclination of the uppermost projecting device permits to suppress or at least drastically reduce the turmoil generated by the uppermost projecting devices compared to horizontal projecting device as disclosed in U.S. Pat. No. 7,645,417 B2 and illustrated in FIG. 7 wherein the bath surface 11" is not flat but exhibits turmoil. Consequently, the cooling homogeneity in the width direction is increased.

Figure 8:
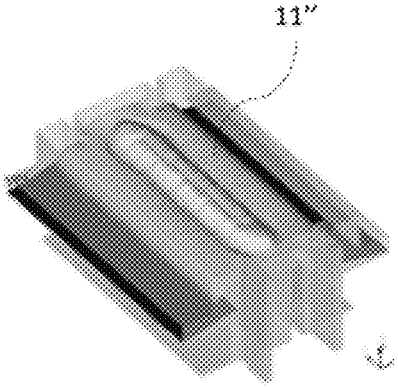
Figure 8 (Prior Art)
FIG. 8 exhibits a simulation of a coolant bath surface 4" of an embodiment as disclosed in the state of the art.

FIG. 8 is a simulation a coolant bath surface 11" of a cooling device having a series of projecting devices oriented essentially horizontally; i.e. having coolant sprayed essentially horizontally, wherein the strip is moving upward. This case corresponds to the one of U.S. Pat. No. 7,645,417 B2. One can observe that turmoil is generated on the coolant bath surface close to the strip. Consequently, the cooling is not uniform along the strip width and degrades the strip quality.

Figure 1:
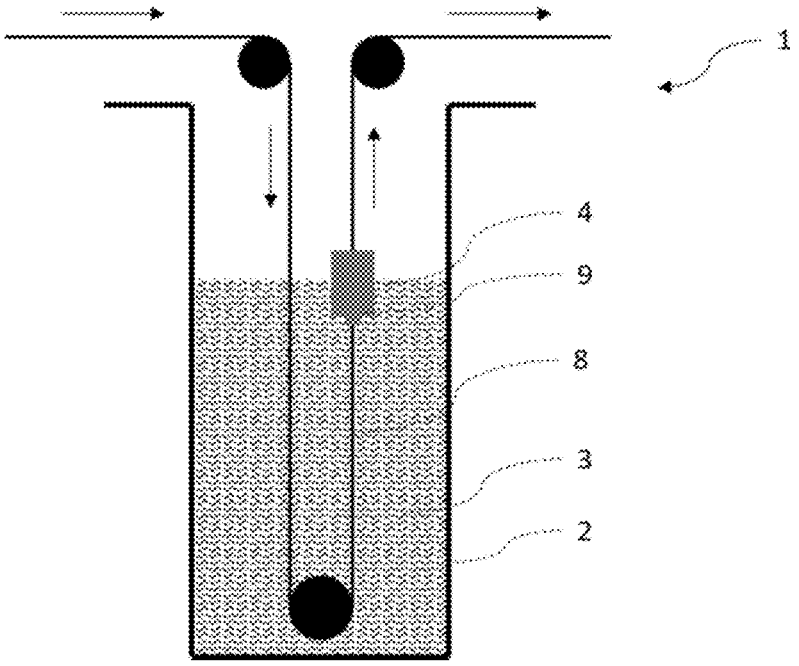
FIG. 1 exhibits an embodiment of a device 1 comprising a tank 2 and a cooling device 4.
Figure 2:
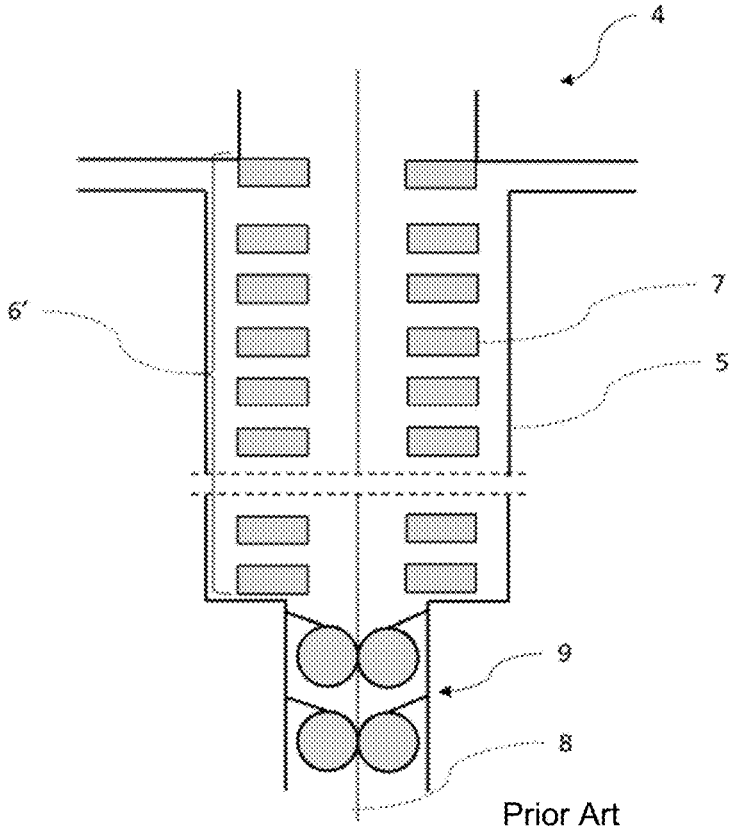
FIG. 2 exhibits an embodiment of a cooling device 4 as disclosed in the state of the art.

The use of such a claimed cooling device 10 is not limit to only one positioned at the strip exit from the cooling device as illustrated in FIG. 1. On the contrary, this claimed cooling device 10 can be positioned at the strip entry of the tank 2, as illustrated in FIG. 9A. Moreover, two claimed cooling devices can be installed on the entrance and exit of the strip of tank 2, as illustrated in FIG. 9B. Such a positioning of one or several claimed cooling devices permits to perform various cooling cycles when used in addition of a tank containing water. For example, the three following thermal cycles are possible if the coolant temperature in the cooling device 10 is lower than the one in the tank 2:

1) slow cooling then fast cooling (FIG. 1),
2) fast cooling then slow cooling (FIG. 9A),
3) fast cooling then slow cooling then fast cooling (FIG. 9B), wherein the fast cooling takes place in the claimed cooling device and the slow cooling is in a tank containing boiling water.

In the prior art, it seems that no solution permits to avoid the formation of turmoi leading to a heterogeneous cooling along the strip width. On the contrary, with the equipment according to the present invention, the cooling homogeneity is improved along the strip width.

Advantageously, both series (18 and 18') have the same number of projecting devices (13) downwardly inclined of an angle of 20° to 40° compared to the horizontal. In order to obtain a homogeneous in the strip width, the inclined projecting device of each series should be facing each other.

Advantageously, the two uppermost projecting devices of both series (18 and 18') are downwardly inclined of an angle of 20° to 40° compared to the horizontal. The two uppermost projecting devices (20 and 20A or 20' and 20'A) of a series correspond to the two immersed projecting devices being the closer to the surface, as illustrated in FIG. 4. Such an arrangement permits to increase even further the cooling homogeneity in the strip width.

Advantageously, the three uppermost projecting devices on both series (18 and 18') are downwardly inclined of an angle of 20° to 40° compared to the horizontal.

Advantageously, the four uppermost projecting devices on both series (18 and 18') are downwardly inclined of an angle of 20° to 40° compared to the horizontal.

Advantageously, all projecting devices located up to a depth of 50 cm from the coolant surface are downwardly inclined of an angle of 20° to 40° compared to the horizontal. Such an arrangement permits to increase even further the cooling homogeneity in the strip width because the formation of gas bubble is reduced even more. Preferably, all projecting devices located up to a depth of 1 meter or 2 meters or 3 meters from the coolant surface are downwardly inclined of an angle of 20° to 40° compared to the horizontal.

Advantageously, said series of projecting devices comprises 10 to 40 devices. Such a quantity of devices permits to ensure a sufficient cooling capacity of the cooling device. More advantageously, each projecting device can spray at least 250 $m^3 \cdot h^{-1}$ of coolant per $m^2$ of strip.

Advantageously, said projecting devices are tubes 14. Preferably, as illustrated in FIGS. 10A and 10B, said tubes are hollow rectangular cuboid. The coolant enters said tubes by opening on their two lateral faces 23, which are preferentially their smallest faces. The coolant exits said tubes by a frontal face 24, which is oriented toward the strip. Preferentially, said frontal face is equipped with a plate having at least an aperture such as rows of round holes, as illustrated in FIG. 10A, and/or at least a slit, as illustrated in FIG. 10B.

Advantageously, said projecting device apertures 13E (See FIG. 3 for example) are at a distance between 30 and 200 mm of said path. The path is referring to the path described by the flat metallic product. On one hand, if the distance between the apertures of the projecting device and the strip is smaller than 30 mm, the moving strip might contact the cooling device which can lead to scratch or damage the strip surface. On the other hand, if the distance is greater than 200 mm, the cooling performance is reduced.

Advantageously, the cooling device does not comprise rolls, such as restraining rolls, between said two openings.

The invention also relates to a cooling method wherein a flat metallic product moving essentially vertically, ascendingly or descendingly, is cooled in a device as described previously, said series of projecting devices eject a coolant flux between 250 $m^3$ and 2,500 $m^3$ per hour per surface of flat product. A coolant flux in that range is sufficient to obtain a cooling speed desired to achieve the desired product properties.

Preferably, said series of projecting devices eject a coolant having a speed between 0.25 $m \cdot s^{-1}$ and 20 $m \cdot s^{-1}$. Such a speed permits to the ejected coolant to reach the strip surface and being reflected horizontally in the gap between the projecting devices which improves the coolant renewal and thus the cooling homogeneity.

Preferably, said series of projecting devices eject a coolant being at a temperature between 10 and 100° C.

Preferably, said cooling device permits to cool said flat metallic product of at least 200° $C. \cdot s^{-1}$. More preferably, said cooling device permits to cool said flat metallic product of at least 500° $C. \cdot s^{-1}$. Even more preferably, said cooling device permits to cool said flat metallic product of at least 1000° $C. \cdot s^{-1}$.

The invention has been described above as to the embodiment which is supposed to be practical as well as preferable at present. However, it should be understood that the invention is not limited to the embodiment disclosed in the specification and can be appropriately modified within the range that does not depart from the gist or spirit of the invention, which can be read from the appended claims and the overall specification.

What is claimed is:

1. A cooling device for a cooling operation of a flat metallic product, the cooling device being located in an ascending or descending vertical path, the cooling device comprising:

a tank filled with a coolant bath defining a coolant surface, the tank including a top opening on an upper surface and a bottom opening on a bottom surface, the flat metallic product capable of passing through the top and the bottom openings so as to describe a path, the bottom opening having a seal;

two series of coolant projectors, each of the coolant projectors of the two series of coolant projectors including an aperture immersed in the coolant bath, the two series of coolant projectors facing each other on each side of the path; any two vertically successive coolant projectors of one of the two series being separated by a gap;

each of the two series of coolant projectors having an uppermost coolant projector defined as a closest of the coolant projectors to the coolant surface, at least the uppermost coolant projector on both sides of the path being downwardly inclined at an angle of 20° to 40° compared to a horizontal.

2. The cooling device as recited in claim 1 wherein each of the two series have a same number of the coolant projectors downwardly inclined at an angle of 20° to 40° compared to the horizontal.

3. The cooling device as recited in claim 1 wherein two uppermost coolant projectors of each of the two series are downwardly inclined at an angle of 20° to 40° compared to the horizontal.

4. The cooling device as recited in claim 1 wherein three uppermost coolant projectors of each of the two series are downwardly inclined at an angle of 20° to 40° compared to the horizontal.

5. The cooling device as recited in claim 1 wherein four uppermost coolant projectors of each of the two series are downwardly inclined at an angle of 20° to 40° compared to the horizontal.

6. The cooling device as recited in claim 1 wherein all coolant projectors located up to a depth of 50 cm from the coolant surface are downwardly inclined at an angle of 20° to 40° compared to the horizontal.

7. The cooling device as recited in claim 1 wherein the two series of coolant projectors include 10 to 40 coolant projectors.

8. The cooling device as recited in claim 1 wherein the coolant projectors are tubes.

9. The cooling device as recited in claim 1 wherein a location of the flat metallic product passing through the cooling device describes a product path, the coolant projector apertures being at a distance between 30 and 200 mm from the product path.

10. A cooling method comprising:

moving the flat metallic product vertically in the cooling device as recited in claim 1, and ejecting a cooling flux between 250 $m^3$ and 2 500 $m^3$ per hour per surface of the flat metallic product via the two series of the coolant projectors.

11. The cooling method as recited in claim 10 wherein the two series of the coolant projectors eject a coolant having speed between 0.25 $m \cdot s^{-1}$ and 20 $m \cdot s^{-1}$.

12. The cooling method as recited in claim 10 wherein the two series of the coolant projectors eject a coolant at a temperature between 1° and 100° C.

13. The cooling method as recited in claim 10 wherein the cooling device cools the flat metallic product at a rate of at least 200° $C. \cdot s^{-1}$.

* * * * *